US009111668B2

(12) United States Patent
Tillner

(10) Patent No.: US 9,111,668 B2
(45) Date of Patent: Aug. 18, 2015

(54) METHOD FOR PRODUCTION OF AN ELECTRICAL WINDING, AND ELECTRICAL CONDUCTOR

(75) Inventor: Siegbert Tillner, Erndtebruck (DE)

(73) Assignee: Essex Europe, Compiegne (FR)

( * ) Notice: Subject to any disclaimer, the term of this patent is extended or adjusted under 35 U.S.C. 154(b) by 88 days.

(21) Appl. No.: 13/696,708

(22) PCT Filed: Mar. 23, 2011

(86) PCT No.: PCT/EP2011/054416

§ 371 (c)(1),
(2), (4) Date: Jan. 15, 2013

(87) PCT Pub. No.: WO2011/141213

PCT Pub. Date: Nov. 17, 2011

(65) Prior Publication Data

US 2013/0199819 A1 Aug. 8, 2013

(30) Foreign Application Priority Data

May 12, 2010 (EP) ..... 10305507

(51) Int. Cl.
*H01B 7/00* (2006.01)
*H01B 11/02* (2006.01)
(Continued)

(52) U.S. Cl.
CPC ..... *H01B 13/0016* (2013.01); *H01B 7/421* (2013.01); *H01F 5/02* (2013.01); *H01F 41/062* (2013.01); *H01F 41/0658* (2013.01); *Y10T 29/49117* (2015.01)

(58) Field of Classification Search
CPC ..... H01F 27/12; H01F 27/08; H01F 27/20; F16L 59/027; F16L 59/22; F16L 11/127; F16L 11/1185; H01B 7/423; H01B 13/0016
USPC ..... 174/15.1, 15.2, 15.6, 47, 117 R, 33, 34; 29/825
See application file for complete search history.

(56) References Cited

U.S. PATENT DOCUMENTS 4,276,102 A * 6/1981 Schaeffer et al. ..... 156/85
4,321,426 A 3/1982 Schaeffer et al.
(Continued)

FOREIGN PATENT DOCUMENTS

DE 2108343 9/1972
DE 2363981 7/1975
(Continued)

OTHER PUBLICATIONS

International Search Report dated Jul. 18, 2011.
(Continued)

*Primary Examiner* — Timothy Thompson
*Assistant Examiner* — Sherman Ng
(74) *Attorney, Agent, or Firm* — Sofer & Haroun, LLP

(57) ABSTRACT

A method is specified for production of an electrical winding for an electrical appliance, in which the winding is embedded in a liquid which is used for cooling. A conductor is first of all produced, in which a multiplicity of insulated electrical individual conductors having a rectangular cross section are arranged in at least one stack, with their flat faces resting on one another. Winding material composed of insulating material is wound around the stack in order to produce common insulation, and the conductor is then shaped to form a single-part winding. A winding material in the form of ribbon or strip and composed of a plastic with impressed shape memory is used for winding around, and has a greater length than its original length, with this greater length being produced by stretching. The finishing winding is heated to a temperature at which the winding material becomes shorter in the winding direction.

3 Claims, 1 Drawing Sheet

(51) Int. Cl.

| | |
|---|---|
| ***H01B 7/02*** | (2006.01) |
| ***H01R 43/00*** | (2006.01) |
| ***H01B 13/00*** | (2006.01) |
| ***H01F 5/02*** | (2006.01) |
| ***H01F 41/06*** | (2006.01) |
| ***H01B 7/42*** | (2006.01) |

(56) References Cited

U.S. PATENT DOCUMENTS

| | | | | |
|---|---|---|---|---|
| 4,384,168 | A * | 5/1983 | Kenney | 174/125.1 |
| 5,175,396 | A * | 12/1992 | Emery et al. | 174/36 |
| 6,087,583 | A | 7/2000 | Runge | |
| 6,228,494 | B1 * | 5/2001 | Emery | 428/377 |
| 2002/0053462 | A1 * | 5/2002 | Runge et al. | 174/128.1 |
| 2002/0084100 | A1 * | 7/2002 | Angell et al. | 174/116 |

FOREIGN PATENT DOCUMENTS

| | | |
|---|---|---|
| DE | 19727758 | 10/1998 |
| EP | 2103637 | 9/2009 |

OTHER PUBLICATIONS

International Preliminary Report on Patentability dated Nov. 13, 2012.

* cited by examiner

METHOD FOR PRODUCTION OF AN ELECTRICAL WINDING, AND ELECTRICAL CONDUCTOR

RELATED APPLICATIONS

This application is a National Phase Application of PCT/EP2011/054416, filed on Mar. 23, 2011, which in turn claims the benefit of priority from European Patent Application No. 10 305 507. 5 filed on May 12, 2010, the entirety of which are incorporated herein by reference.

BACKGROUND

1. Field of the Invention

The invention relate. to a method for manufacturing an electrical winding for an electrical device in which the winding is embedded in a liquid which serves for cooling, by means of which initially a conductor is manufactured in which a plurality of insulated electrical individual conductors, each having a rectangular cross section, are arranged in at least one stack with their flat sides resting against each other, around which for producing a common insulation of winding material consisting of insulation material and with which subsequently is shaped into a single piece winding, as well as an electrical conductor (DE 197 27 758 A1).

2. Description of Related Art

A conductor which can be used for this type of winding is, for example, a twisted conductor which is used in windings for transformers in which oil is contained as the cooling agent. Such a twisted conductor consists of two stacks of flat insulated electrical individual conductors which are twisted together along- their extension by a continuous exchange of their places from, one stack into the other. In accordance with the above mentioned DE 197 27 758 A1, several layers of paper are wound as insulation. Between the windings of such a conductor a gap remains for cooling agent to pass through, wherein the gap is adjusted by means of spacer pieces. When the winding is manufactured, and also during the operation of the same, it may happen that the paper layers loosen and are fluffed up and the gap between the windings becomes clogged, at least partially. Cooling of the winding is significantly impaired as a result.

OBJECTS AND SUMMARY

The invention is based on the object of further developing the above described method in such a way that a sufficient cooling of a winding, produced with the corresponding conductor, is permanently ensured.

In accordance with the invention, this object is met in that

- a band or strand shaped winding material of a synthetic material, having a distinctive shape memory, is wound around a conductor, wherein, as a result of stretching, the winding material has a greater length as compared to its original length and. has a shorter length when heat is applied, and
- the finished winding is heated to a temperature at which the winding material becomes shorter in the winding direction.

The winding material used in this method may be constructed, for example as a band, or fabric, or string. It consists of a synthetic material with distinctive shape memory which, by way of prefabrication, is extended and, in the resulting extended state, is held or "frozen" by cooling. Because of its shape memory, such a winding material, which is composed of one or several layers, returns to its original length when heat is applied. Accordingly, it then becomes shorter. A winding material extended in accordance with the invention can be wound using conventional technology around the stack of individual conductors, i.e. the conductor, so that it surrounds the conductor sufficiently tightly. The winding with the winding material corresponds, with respect to strength, approximately to the conventional winding using other materials, so that the conductor has a sufficient bending- capability for its further processing. Therefore, the conductor can also be processed using conventional technology into a winding whose coils are separated by a gap. After the winding has been finished, it is heated to a predetermined minimum temperature. For this purpose, it can be introduced into a drying furnace for driving out residual moisture and for baking lacquer, if such a lacquer is applied to the individual conductor as insulation and for solidification. As a result of the heat supply taking place, the winding material becomes shorter in the direction of its original length to which it wants to return, so that it is wound with increased force around the conductor. The gap formed between the windings of the coil thus remains permanently in its entire inner width, so that the cooling of the winding is continuously ensured during its operation.

Synthetic materials having distinctive shape memory within the sense of the invention are disclosed, for example, in EP 2 103 637 A2. They are essentially polymers and/or oligomers with different basic materials.

BRIEF DESCRIPTION OF THE DRAWINGS

The method according to the invention and a conductor manufactured by the method will be explained with the aid of the drawings as embodiment, examples.

In the drawing.

DETAILED DESCRIPTION

Instead of the word "winding material," in the following the word "band" will be used for simplicity's sake.

Figure 1:
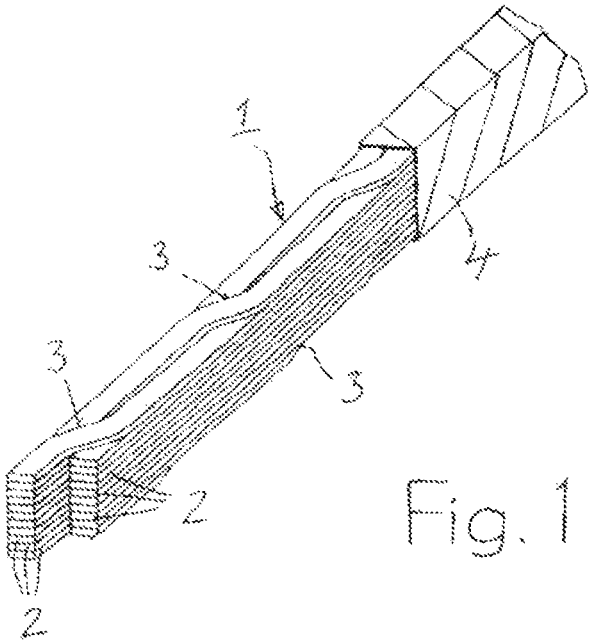
FIG. 1 shows a section of a conductor according to the invention.

In the simplest embodiment, the conductor according to the invention is surrounded by a stack of flat insulated electrical individual conductors with an approximately rectangular cross section, which rest against each other with their flat sides. In a preferred embodiment, the conductor is a twisted conductor with two stacks of individual conductors placed next to each other, as illustrated in FIG. 1, The individual conductors can be insulated, for example, with a so-called baking lacquer which is activated when heat is supplied and baking of the individual conductors in the respective stack is effected.

The twisted conductor 1 illustrated in FIG. 1—in the following called "conductor 1" for short—consists of two stacks of flat, insulated electrical individual conductors 2 having an approximately rectangular cross section, which are placed on top of each other with their flat sides. The individual conductors 2 consist preferably of copper. They are insulated with an insulation lacquer, particularly a baking lacquer. In order to keep the influence of the current displacement, in a winding as short as possible when using the conductor 1, a continuously repeating exchange of individual conductors 2 from one stack to the other is carried out over the entire length of the coil. For this purpose, the individual conductors 2 are crimped by means of a suitable tool at locations 3 disclosed in FIG. 1, namely one individual conductor arranged at the top and an individual conductor arranged at the bottom. This is carried out continuously. The regular exchange of the individual conductors 2 in the cross section of the conductor 1, carried out as a result, also leads to lower eddy current losses.

Wound around the conductor 1 is, as insulation, a band 4 which is composed of a synthetic material with distinctive shape memory. In the extended state into which the band has been transposed by expansion and "freezing," the band is wound around the conductor with conventional tension. It may be wound around the conductor so as to overlap or on edge, however, also with gaps between the individual windings.

Figure 2:
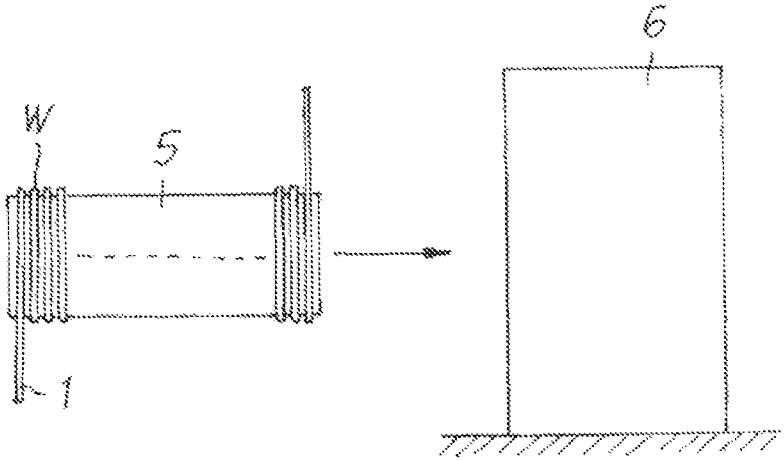
FIG. 2 schematically shows an arrangement for carrying out the method according to the invention.

The conductor 1 is manufactured continuously in large lengths, quasi-endlessly. It may be wound onto a coil or may also be further processed directly into a winding for an electrical device, particularly a transformer. For such a further processing the conductor 1 may be transported, together with the coil, to another manufacturing location and may there be unwound from the coil. For manufacturing an electrical winding W, the conductor 1, according to FIG. 2, is wound onto a mechanically stable core 5 with predetermined diameter, namely with a gap or an opening between the windings which can be adjusted by mounting spacer members. The finished winding W is heated prior to its use in an electrical device up to a predetermined temperature at which the band 4 shrinks or becomes shorter in its longitudinal direction and places itself with increased tension around the conductor 1. For this purpose, the winding W may be introduced into a drying furnace where it is heated, for example, for forcing out residual moisture and/or for the activation of a baking lacquer applied to the individual conductor 2.

The invention claimed is:

1. A method for manufacturing an electrical winding for an electrical device in which the winding is embedded in a cooling liquid, comprising:

manufacturing a conductor by placing a plurality of insulated individual electrical conductors with rectangular cross sections with their flat sides against each other in at least one stack in order to produce a commonly insulated conductor, the manufacturing comprising shaping the conductor into a single piece winding, wherein the conductor is surrounded by a band or strand shaped winding material comprising a synthetic material having a distinctive shape memory which has a greater length, as compared to its original length produced by stretching, and which is configured to shorten when heated, wherein the greater length is produced by stretching the winding material before applying to said individual electrical conductors, and wherein said method includes heating the conductor on the single piece winding to a temperature at which the winding material shortens in the winding direction.

2. A method for manufacturing an electrical winding for an electrical device in which the winding is embedded in a cooling liquid, comprising:

providing a pre-stretched band or strand shaped winding material of a synthetic material having a distinctive shape memory, the winding material being configured to shorten when heated, manufacturing a conductor by placing a plurality of insulated individual electrical conductors, each having a rectangular cross section presenting fiat sides, with their flat sides against each other in at least one stack in order to produce a commonly insulated conductor, the manufacturing comprising shaping the conductor into a single piece winding, wherein the conductor is surrounded by the pre-stretched winding material having a greater length, as compared to an un-stretched length, and heating the conductor on said single piece winding to a temperature at which the winding material shortens in the winding direction.

3. A method for manufacturing an electrical winding for an electrical device in which the winding is embedded in a cooling liquid, said method comprising the steps of:

elongating a band or strand shaped winding material of a synthetic material having a distinctive shape memory, the winding material being configured to shorten when heated, manufacturing a conductor by placing a plurality of insulated individual electrical conductors with rectangular cross sections with their flat sides against each other in at least one stack in order to produce a commonly insulated conductor, the manufacturing including shaping the conductor into a single piece winding, wherein the conductor is surrounded by the elongated winding material, and heating the conductor on the single piece winding to a temperature at which the winding material shortens in the winding direction.

* * * * *